United States Patent [19]

Olen

[11] Patent Number: 4,475,876

[45] Date of Patent: Oct. 9, 1984

[54] OIL PURGE SYSTEM FOR COLD WEATHER SHUTDOWN OF OIL FLOODED SCREW COMPRESSOR

[75] Inventor: Donald S. Olen, Milwaukee, Wis.

[73] Assignee: Allis-Chalmers Corporation, Milwaukee, Wis.

[21] Appl. No.: 453,517

[22] Filed: Dec. 27, 1982

[51] Int. Cl.[3] ..... F04C 18/16; F04C 29/02

[52] U.S. Cl. ..... 418/84; 418/85; 137/207.5; 184/6.22

[58] Field of Search ..... 418/84, 85, 87, 201; 184/6.16, 6.22, 6.4, 104 R; 126/420; 137/62, 207.5, 209

[56] References Cited

U.S. PATENT DOCUMENTS 1,603,426 10/1926 Thomson ..... 418/85
3,191,854 6/1965 Lowler et al. ..... 418/85
4,138,996 2/1979 Cartland ..... 126/420
4,246,926 1/1981 Morello ..... 137/209

FOREIGN PATENT DOCUMENTS 2715610 10/1977 Fed. Rep. of Germany ..... 418/85

*Primary Examiner*—John J. Vrablik
*Attorney, Agent, or Firm*—Timothy R. Conrad

[57] ABSTRACT

A system for purging the lubricating oil from the oil connecting lines (27, 31) and cooler (23) of an oil circulating system for a flooded type screw compressor (10) when the compressor (10) is shut down whereby the lubricating oil is forced into a reservoir (18) which is positioned within a heated enclosure (22) so that upon restarting the compressor (10) in extremely cold weather, cold stiff oil will not be present in the oil connecting lines (27, 31) and cooler (23), thus avoiding delays in compressor start-up.

4 Claims, 1 Drawing Figure

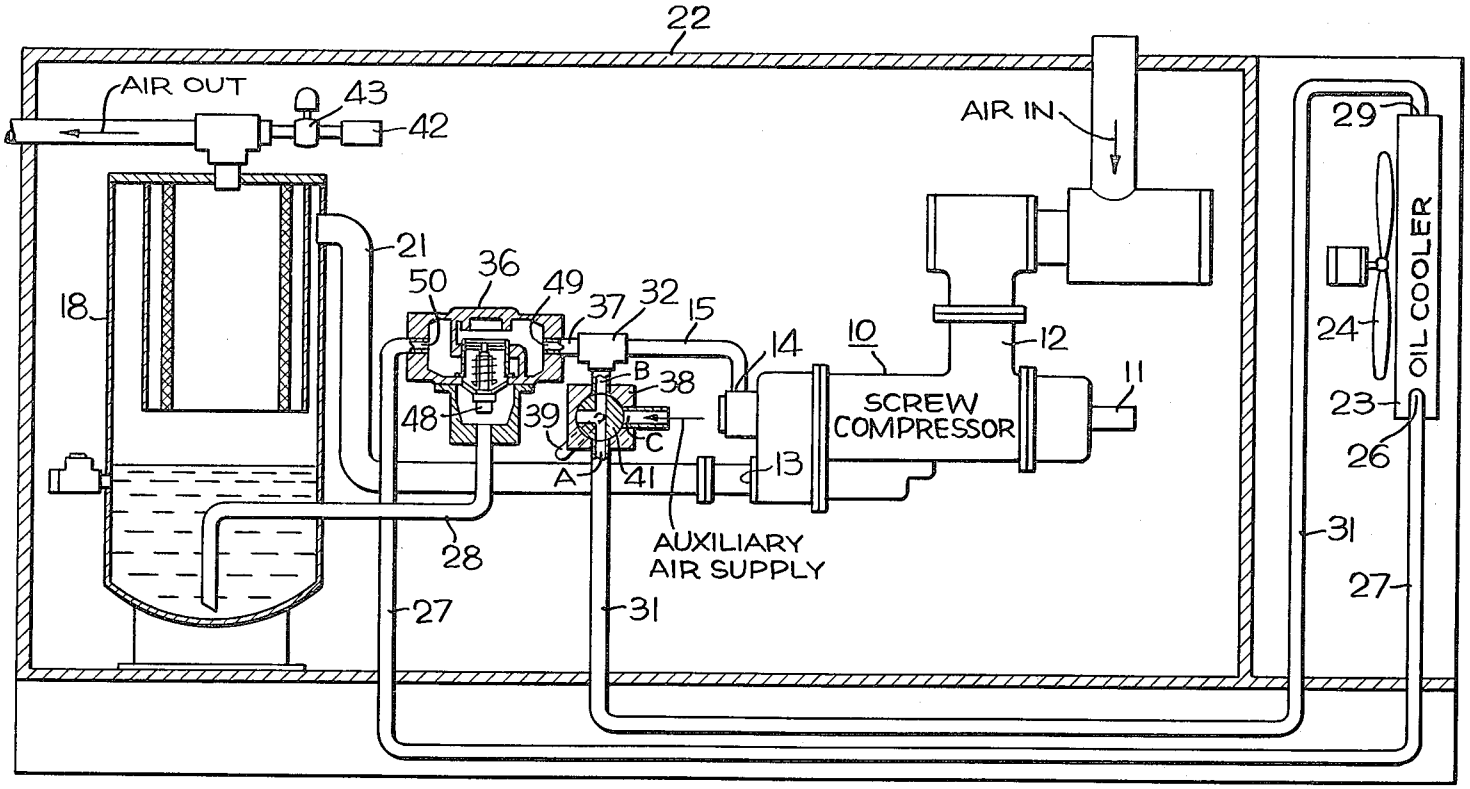
OIL COOLER
29
24
23
26
27
31
AIR IN
11
12
SCREW COMPRESSOR
10
14
13
AUXILIARY AIR SUPPLY
22
15
32
38
B
C
41
37
A
39
49
36
48
28
50
21
42
43
AIR OUT
18

OIL PURGE SYSTEM FOR COLD WEATHER SHUTDOWN OF OIL FLOODED SCREW COMPRESSOR

FIELD OF THE INVENTION

This invention relates to rotary screw compressors for compressing various fluids, preferably air, and more particularly to that type of rotary compressor wherein lubricating oil is delivered into the compressing chambers and serves to lubricate the moving parts of the compressor and to cool the compressed fluid. The oil is discharged with the compressed fluid and separated therefrom prior to delivery of the compressed fluid to the point of use.

BACKGROUND OF THE INVENTION

One of the common uses of oil flooded screw compressors is on portable blast hole drills to provide air to bail the cuttings out of the hole and to cool the drill bit. Blast hole drills are frequently used in strip mining operations that are often located in geographical areas having very cold climates. In such installations, the compressor and air/oil reservoir are installed in a heated machinery house on the drill while the oil cooling radiator or cooler is located outside the house where it is exposed to large volumes of cool atmospheric air which are required to cool the oil.

During extended shutdown periods in subzero temperatures, the oil thickens in the radiator and in the connecting lines which are located outside of the heated machinery house on the drill. The oil may then be too thick to flow properly through the exterior radiator and connecting lines when the thermostatic control valve opens shortly after start-up, thus preventing flow of cooled lubricating oil to the compression chamber. An excess air/oil mixture temperature will result in the compressor shutting down after running only a few minutes. To avoid this problem, in the past portable heaters were used to heat the oil in the exterior radiator or cooler and in the connecting lines causing substantial delays in restarting the compressor.

The oil purge system of this invention is designed to prevent the cold weather start-up problems for such compressors and avoids having to apply supplemental heat to the oil cooling radiator and connecting lines and the attendant downtime of the compressor.

Therefore, it is a primary object of this invention to provide an oil purge system for the oil cooling radiator and connecting lines of a flooded type screw compressor.

DETAILED DESCRIPTION OF THE PREFERRED EMBODIMENT

Referring to the drawing, the numeral 10 indicates a rotary flooded type screw compressor having an input shaft 11 driven by a motor or engine, not shown. The input shaft 11 rotates one or two screws operating within an interior chamber of the compressor to compress air or other compressible fluids. The compressor 10 includes an air inlet 12, an air outlet 13, an oil inlet 14 to which oil is supplied by an oil conduit means in the form of an oil line 15. Lubricating oil delivered to the oil inlet 14 from a separation tank 18 passes directly into the compressing chamber of the compressor where it mixes with air or fluid being compressed and is discharged through the discharge outlet 13 of the compressor into the separation tank or reservoir 18, via conduit line 21, where the oil is separated from the compressed air and drops to the bottom of the reservoir 18 and is available to be reused. As illustrated, the compressor 10 and the reservoir 18 are contained in a heated enclosure or house 22 which is maintained at a predetermined temperature.

Large quantities of oil are required for the flooded type screw compressor 10 to cool the air being compressed, lubricate the internals and seal the rotors to prevent loss of air volume back to the inlet 12. During operation, the oil that is separated in the reservoir 18 from the air/oil mixture discharged by the compressor is very hot and requires substantial cooling before it is returned to the compressor. The cooling function is provided by an oil cooling radiator or cooler 23 positioned outside of a house or enclosure 22. The cooler 23 has an inlet or input port 26 connected to the reservoir 18 by oil conveying line means including a line 27 and a line 28 and has an outlet or discharge port 29 connected to the compressor inlet 14 by an oil conveying line means in the form of line 31 connected to the line 15. A cooler fan 24 is provided for the cooler 23 to provide proper heat exchange to cool the oil before it re-enters the compressor 10. In cold climate applications of drill rigs, the compressor, the driving motor or engine and the reservoir are placed within a heated machinery house or enclosure 22 to permit start-up and efficient operation of these components and the cooler 23 is located outside the enclosure where it is exposed to large volumes of cool air. During shutdown, the heated enclosure 22 also serves as warming means for the oil in the reservoir 18 and for the oil in the oil lines within the enclosure, thereby ensuring flowability of the oil to the compressor 10 at start-up.

A three-way thermostatic valve 36 is positioned in a bypass line 37 between the reservoir 18 and the oil inlet 14 of the compressor and more specifically at the junction of lines 27, 28 and 37. As illustrated, the bypass line 37 has one end connected to the oil conduit means in the form of line 15 and its other end connected through the temperature sensitive thermostatic valve 36 to an intermediate portion of the oil conveying line means formed by lines 27, 28.

Upon start-up of the compressor 10, oil is drawn from the reservoir 18 through the thermostatic valve 36 which is open to the oil inlet 14 of the compressor and closed to line 27. When oil is below a predetermined temperature, the flow control element 48 of the thermostatic valve 36 is in its illustrated bypass position thereby permitting oil from the reservoir 18 to flow through the bypass line 37 to line 15 and thence to the oil inlet 14 of the compressor 10. When the oil reaches a predetermined temperature, the valve element 48 automatically shifts upwardly to a position closing port 49 and opening port 50 causing oil from the reservoir 18 to flow through the line 27, the cooler 23 and the line 31 en route to the oil inlet 14 of the compressor 10.

A manually controlled three-way control valve 38 is installed in the line 31 between the discharge side of the cooler 23 and the tee coupling 32 connecting lines 37, 15 and 31. The flow control valve element 41 of the valve 38 is normally in its illustrated operating position in which the valve ports A and B are open to one another and port C is closed so the oil flows from the cooler 23 through the line 31, the valve 38 and the line 15 to the oil inlet 14. Port C is adapted for connection to a source of compressed air, or it can be permanently connected to such source, for purposes that will be explained in connection with the following description of the operation of the oil purge system.

OIL PURGE SYSTEM

The oil purge system of this invention utilizes air from an auxiliary air compressor or an air reservoir, not shown, to push the oil in the radiator or cooler 23 and in the lines 31, 27 back into the reservoir 18 which is located inside the heated machinery house 22 on the drill. This is achieved by use of the three-way valve 38 which includes a manual spring return handle 39 operable to rotate the rotatable flow control element 41. Oil normally flows straight through the valve 38 (port A to port B) from the cooler 23 to the screw compressor 10.

In order to purge the oil from the cooler after shutdown at subzero temperatures, the valve handle 39 is normally rotated 90° counterclockwise to close port B of the valve 38 and to open port C to admit compressed air (at 90–150 pounds per square inch) to purge the oil from the cooler 23 and the connecting lines 31, 27 forcing it into the air/oil reservoir 18. Completion of the purging can be detected when compressed air is heard venting through the reservoir blowdown muffler 42. After purging, the valve handle 39 is manually released and element 41 of the valve 38 is spring returned to its normal operating position in which port C is closed to the compressed air supply and ports A and B are open to one another. To prevent partial refilling of the oil cooler 23 and the lines 27, 31 by gravity after the system has been purged, the thermostatic control valve 36 is located above the maximum oil level in the reservoir 18. It should be understood that at shutdown, the pressure in the reservoir drops to atmospheric pressure by venting through the blowdown valve 43 and muffler 42.

As soon as the screw compressor 10 is restarted, the resulting reservoir air pressure will push the oil back through lines 28, 37, 15 and through line 27, cooler 23 and line 31.

It is understood that the invention is not to be limited to the specific construction or arrangement of the parts shown, but rather they may be widely varied within the scope of the appended claims.

The embodiments of the invention in which an exclusive property or privilege is claimed are defined as follows:

1. An oil circulating system for rotary fluid compressors, comprising a heated enclosure, a rotary screw-type compressor in said enclosure having a fluid inlet for receiving fluid to be compressed from the exterior of said enclosure, a fluid discharge for compressed fluid and an oil inlet for lubricating oil which mingles with and is discharged with the compressed fluid, a separation tank in said enclosure connected to said fluid discharge for receiving discharged compressed fluid and oil from the compressor, an oil cooler disposed on the outside of said enclosure and having an inlet and an outlet, a first oil line means connecting said oil cooler inlet to said tank, a second oil line means connecting said oil cooler outlet to said oil inlet of said compressor, a source of compressed air, valve means interposed in said second line means within said enclosure and including a flow control element having a first position of adjustment in which flow of oil is permitted in said second line means from said cooler to said compressor and a second position of adjustment preventing flow of oil in said second line means to said oil inlet of said compressor, valve means in said second oil line means within said enclosure adapted for connection to said source of compressed air and having open and closed positions, when said last mentioned valve means is in its open position and connected to said source of compressed air, said compressed air being operative to force lubricating oil from said second line means, cooler and first line means to said tank, and a temperature sensitive valve within said enclosure operatively associated with said first and second oil means automatically passing oil from said tank to said oil inlet of said compressor bypassing said cooler when the temperature of said oil is below a predetermined value.

2. An oil circulating system for a fluid compressor comprising:

a heated enclosure, a rotary screw-type compressor within said enclosure including a fluid inlet for admitting compressible fluid from the exterior of said enclosure, a fluid outlet for compressed fluid and an oil inlet through which lubricating oil enters the compressor, mixes with the fluid being compressed and is discharged with the compressed fluid from said fluid outlet, a separation tank disposed within said enclosures, a conduit connecting said tank disposed within said enclosures, a conduit connecting said tank in fluid receiving relation to said fluid outlet, oil conduit means connected to said oil inlet, a cooler disposed exteriorly of said enclosure and having an input port and a discharge port, a first oil conveying line means having one end connected to said discharge port, a second oil conveying line means having one end connected to said input port and its other end connected to said tank, a source of compressed air, a control valve means within said enclosure having a first port adapted for connection to said source of compressed air, a second port connected to the other end of said first oil conveying line means and a third port connected to said oil conduit means, said control valve means having a first position of adjustment wherein said first port is blocked and said second port is in free-flow communication with said third port and a second position of adjustment in which said third port is blocked and said first port is in free-flow communication with said second port, in said second position of adjustment the oil in said cooler and oil conveying line means is purged to said tank by admission of compressed air through said first port, and oil flow means within said enclosure for bypassing said cooler during compressor start-up including a bypass line having one end connected to said oil conduit means and having its other end in fluid communication with said tank, and a temperature sensitive valve having an open position permitting flow through said bypass line when the oil temperature is below a predetermined temperature and having a closed position blocking flow in said bypass line thereby forcing oil to flow through said cooler end route to said oil inlet when the temperature of said oil exceeds said predetermined temperature.

3. The system of claim 2 wherein said other end of said by pass line is connected through said temperature sensitive valve to an intermediate portion of said second oil conveying line means.

4. The system of claim 3 wherein said temperature sensitive valve is at a sufficient elevation to prevent gravity flow of oil from said reservoir to said cooler.

* * * * *

UNITED STATES PATENT OFFICE

CERTIFICATE OF CORRECTION

Patent No. 4,475,876 Dated October 9, 1984

Inventor(s) Donald S. Olen

It is certified that error appears in the above-identified patent and that said Letters Patent are hereby corrected as shown below:

Column 4, line 16, "line" was omitted before "means";

Column 4, lines 33 and 34 should have been omitted.

Signed and Sealed this

*Sixteenth* Day of *April 1985*

[SEAL]

*Attest:*

DONALD J. QUIGG

*Attesting Officer* . *Acting Commissioner of Patents and Trademarks*